US010376764B2

(12) United States Patent
Eller et al.

(10) Patent No.: US 10,376,764 B2
(45) Date of Patent: Aug. 13, 2019

(54) TRAINING MANNEQUIN

(71) Applicants: Jason R. Eller, Cibolo, TX (US); Carl G. Simpson, San Antonio, TX (US)

(72) Inventors: Jason R. Eller, Cibolo, TX (US); Carl G. Simpson, San Antonio, TX (US)

(73) Assignee: Jason R. Eller, Cibolo, TX (US)

( * ) Notice: Subject to any disclaimer, the term of this patent is extended or adjusted under 35 U.S.C. 154(b) by 215 days.

(21) Appl. No.: 15/482,750

(22) Filed: Apr. 8, 2017

(65) Prior Publication Data

US 2017/0296897 A1 Oct. 19, 2017

Related U.S. Application Data

(60) Provisional application No. 62/320,504, filed on Apr. 9, 2016.

(51) Int. Cl.
*A63B 69/34* (2006.01)
*A63B 71/06* (2006.01)
(Continued)

(52) U.S. Cl.
CPC ..... *A63B 69/34* (2013.01); *A63B 24/0062* (2013.01); *A63B 69/004* (2013.01);
(Continued)

(58) Field of Classification Search
CPC ... A63B 69/34; A63B 69/004; A63B 69/0053; A63B 71/145; A63B 24/0062;
(Continued)

(56) References Cited

U.S. PATENT DOCUMENTS 3,250,533 A 5/1966 Nicholson, II
3,387,842 A 6/1968 Edgar
(Continued)

FOREIGN PATENT DOCUMENTS

EP 2703052 3/2014
EP 2762206 A2 8/2014
(Continued)

OTHER PUBLICATIONS

About Century | Timeline, The Daily Oklahoman, Business Section, http://www.Centurymartialarts.com/about/timeline [downloaded Nov. 4, 2016], US.
(Continued)

*Primary Examiner* — Andrew S Lo

(74) *Attorney, Agent, or Firm* — Mason A. Gross; The Law Office of Mason A. Gross, PLLC

(57) ABSTRACT

A rotatable training mannequin used for training fighters or contact sports athletes is constructed of materials that mimic or simulate the upper human body. A sensor embedded in the training mannequin's head senses, detects, and transmits signals containing data for computer analysis. The data is related to motion parameters, which include linear and angular accelerations and velocities, of the training mannequin as a result of impacts and power strikes made by trainee to the training mannequin. Analysis provides feedback to the trainee related to the motion parameters to help the trainee learn proper footwork and where and how to make effective strikes. The parameter values obtained from the training mannequin can be calibrated and/or correlated against current or future real human parameter values due to strikes or other forces that produce damaging effects, such as concussions, and the training mannequin can be used to avoid or learn about concussions.

25 Claims, 10 Drawing Sheets

(51) Int. Cl.
*A63B 24/00* (2006.01)
*A63B 69/00* (2006.01)
*A63B 71/14* (2006.01)

(52) U.S. Cl.
CPC ..... *A63B 69/0053* (2013.01); *A63B 71/0622* (2013.01); *A63B 71/145* (2013.01); *A63B 2071/0683* (2013.01); *A63B 2220/30* (2013.01); *A63B 2220/40* (2013.01); *A63B 2220/803* (2013.01); *A63B 2220/833* (2013.01); *A63B 2220/836* (2013.01); *A63B 2225/09* (2013.01); *A63B 2225/50* (2013.01); *A63B 2244/102* (2013.01)

(58) Field of Classification Search
CPC ..... A63B 71/0622; A63B 2225/50; A63B 2225/09; A63B 2220/30; A63B 2071/0683; A63B 2220/803; A63B 2220/40; A63B 2244/102; A63B 2220/836; A63B 2220/833
See application file for complete search history.

(56) References Cited

U.S. PATENT DOCUMENTS 4,088,315 A 5/1978 Schemmel
4,309,029 A 1/1982 Tomko
4,691,556 A * 9/1987 Mellander ..... G01M 17/0078 73/1.15
4,702,472 A 10/1987 Anquetil
4,974,833 A 12/1990 Hartman
5,437,590 A 8/1995 D'Alto
5,553,860 A 9/1996 Zelikovich
5,723,786 A 3/1998 Klapman
5,971,398 A 10/1999 Broussard
6,110,079 A * 8/2000 Luedke ..... A63B 24/0062 446/268
6,416,445 B1 7/2002 Nelson
6,508,747 B1 * 1/2003 Cook ..... A63B 71/0605 482/112
6,893,384 B2 5/2005 Triani
7,204,165 B1 * 4/2007 Plaga ..... G01M 17/0078 73/12.01
7,357,760 B1 4/2008 Rios
7,384,380 B2 6/2008 Reinbold
D637,765 S 5/2011 Singh
8,021,281 B2 9/2011 Forsell
8,079,938 B2 12/2011 Jones
8,337,336 B2 12/2012 Jones
8,740,759 B2 6/2014 Knight
8,777,818 B1 * 7/2014 Tate, Jr. ..... A63B 69/004 482/83
9,056,234 B2 1/2015 Pysden
9,021,857 B1 5/2015 Squire
9,039,564 B2 5/2015 Chang
9,050,514 B1 6/2015 Mirza
9,211,464 B2 12/2015 Francis
9,227,128 B1 1/2016 Carfagna
9,295,892 B2 3/2016 Harrigan
9,552,747 B1 * 1/2017 Lytle ..... G09B 23/30
2002/0077223 A1 6/2002 Zai
2005/0177335 A1 * 8/2005 Crisco, III ..... A42B 3/046 702/141
2005/0266967 A1 * 12/2005 Considine ..... A63B 69/20 482/84
2009/0000377 A1 1/2009 Shipps
2009/0098985 A1 4/2009 Gonzalez
2009/0176632 A1 7/2009 Wiber
2010/0311025 A1 * 12/2010 Everett ..... C08L 89/04 434/262
2011/0111924 A1 5/2011 Jones
2011/0118092 A1 5/2011 Keary, III
2011/0172060 A1 7/2011 Morales
2012/0053016 A1 3/2012 Williamson
2012/0070814 A1 * 3/2012 Iida ..... G09B 23/286 434/270
2012/0096960 A1 * 4/2012 Galbreath ..... A61B 5/1036 73/866.4
2012/0108394 A1 5/2012 Jones
2013/0053652 A1 * 2/2013 Cooner ..... A61B 5/0476 600/301
2013/0065731 A1 3/2013 Jones
2013/0122477 A1 * 5/2013 Everett ..... C08L 89/04 434/272
2013/0137554 A1 5/2013 Knight
2013/0150684 A1 * 6/2013 Cooner ..... A61B 5/1101 600/595
2013/0189795 A1 * 7/2013 Mentzer ..... G01N 33/5432 436/501
2013/0224707 A1 8/2013 Newkirk
2014/0066266 A1 3/2014 Chang
2014/0080681 A1 3/2014 Knight
2014/0128226 A1 5/2014 Chang
2014/0155228 A1 * 6/2014 Salerno ..... A63B 69/004 482/84
2014/0206504 A1 7/2014 Barreras
2014/0336014 A1 11/2014 Francis
2014/0372440 A1 12/2014 Cains
2014/0378281 A1 * 12/2014 Mazi ..... A63B 69/34 482/83
2015/0018174 A1 * 1/2015 Partlo ..... A63B 69/201 482/87
2015/0057131 A1 2/2015 Manley
2015/0065312 A1 3/2015 Harrigan
2015/0258374 A1 9/2015 Helanto
2015/0369694 A1 * 12/2015 Neale ..... G01M 7/08 73/12.01
2016/0101338 A1 4/2016 Daniels
2016/0175677 A1 6/2016 Stahl
2016/0220882 A1 8/2016 Milligan
2017/0261416 A1 * 9/2017 Wu ..... G01B 11/16
2018/0047305 A1 * 2/2018 Lee ..... G09B 23/32
2018/0211568 A1 * 7/2018 Panzer ..... G01M 7/08

FOREIGN PATENT DOCUMENTS

EP 2918316 A1 9/2016
WO WO2007023247 A1 3/2007
WO WO2011047410 A1 4/2011
WO WO2013040416 A2 3/2013
WO WO2014146136 A1 9/2014
WO WO2015027045 A1 2/2015

OTHER PUBLICATIONS

Borden, What Happened Within This Player's Skull, New York Times, Jan. 9, 2017. US.

* cited by examiner 2
20
1
20A
2
7B
7
4
5
3
20B
7A
10
10
11
12
16
29
15
17
14
13
13
18
13

TRAINING MANNEQUIN

CROSS-REFERENCE TO RELATED APPLICATIONS

This application claims the benefit of U.S. Provisional Application No. 62/320,504, filed Apr. 9, 2016.

TECHNICAL FIELD

The present invention generally is related to an anthropomorphic human surrogate used as a training mannequin for boxing or martial arts. More particularly, the present invention is related to a training mannequin constructed of materials that mimic or simulate the human head, neck, and torso and having one or more sensors embedded in the head. The sensors are for sensing, detecting, and transmitting to a computer for analysis data related to motion parameters, such as linear and angular accelerations, velocities, and other motion vectors of the training mannequin attributable to the impact and power of strikes or punches by a contact-sports athlete or trainee to the training mannequin.

BACKGROUND

Mixed martial arts (MMA) is a full contact combat sport that allows the participant to strike and grapple whether standing or on the ground, employing techniques from other combat sports and martial arts. The primary goal in an MMA or boxing contest is to render the opponent either defenseless or unconscious. The Ultimate Fighting Championship (UFC), in a rather perverse manner, typically pays the fight winner for rendering his or her opponent unconscious by a complete knockout, with a $50,000 "knock-out-of-the-night" bonus. Such unconsciousness, in the medical community, equates to a severe concussion, and this type of trauma, whether struck with a fist, knee, elbow, or glove, may have permanent and lasting effects to the brain material itself, both immediately and long-term. Nonetheless, MMA is a sanctioned sport that enjoys global appeal.

The force it takes to cause a concussion is not known with absolute certainty, and will vary with the individual affected, although a value of 95 Gs is generally accepted, where G-force, stands for the force of acceleration on a body measured in g's, and 1.0 g is equal to the force of gravity at the Earth's surface, i.e., 9.8 meters/sec$^2$. Loss of consciousness and head trauma in MMA occur with higher frequency and severity than in NFL football. Yet, to date, the national sports media have not focused much attention on the serious head trauma produced by MMA compared to other contact sports, such as NFL Football. At the same time, professional MMA participants seem to lack awareness of how to achieve a "knock out" more effectively other than by learning first-hand in the fighting ring. To the inventors' knowledge, there is no current technology that actually can measure the internal brain mechanism for traumatic loss of consciousness intentionally induced in order to win in MMA. Such technology would be useful in training and also in protecting MMA fighters.

Many scientific finite head element (FHE) models as well as the Wayne State University Head Injury Model curves predict that concussions should occur at head velocities in the range of velocities inflicted during MMA fighting. Evidence indicates that traumatic head rotation in the coronal plane, better known as the X rotational axis of the head, produces the majority of knockout concussions during MMA matches. Based on vast experience in trauma-induced neurological brain disorders, the inventors hypothesize that it is the corpus callosum found in the human brain which sustains the most formidable damage during a head strike. The corpus callosum is a broad band of nerve fibers joining the two hemispheres of the real human brain. The rotational acceleration of the head produces significant force upon the transverse axonal fibers of the corpus callosum, and may produce tearing and disruption of these fibers, which further produces retrograde axonal and neuron cell death, leading to possible permanent consequences from this head trauma.

Punching bags and laboratory-based "crash dummies" equipped with a surrogate human head have previously been used to measure external forces from strikes or blows. Although some of these training devices provide a visible target for the trainee to aim for (punching bags do not), striking the visible target provides little feedback to the trainee. In other studies, mouthpiece sensors and skin-adhesive sensors available from current sensor manufacturers have been employed to monitor impacts athletes receive. These sensors communicate signals sensed from impacts via Blu-Tooth or Wi-Fi to a GUI (Graphical User Interface) on a computer for analysis. Such systems monitor head impacts sustained during training or play because they are considered extremely dangerous to long-term mental health. These other training devices, however, do not yield metrics for the forces the corpus callosum region of the brain experiences during physical blows to the head. This lack of metrics means the athlete receives no or little feedback during training.

SUMMARY

Embodiments of the invention provide a concussion-predictor model, which is based upon an anthropomorphic training mannequin with human-like material properties and physical features. The training mannequin contains an accelerometer sensor located in its "brain" at a position that represents a very particular portion of the human brain, the corpus callosum, which is most closely associated with acute and chronic brain trauma and loss of consciousness. The built-in or embedded accelerometer sensor produces signals from that portion of the training mannequin's brain that most likely would indicate both concussion symptoms and neurological sequelae of traumatic brain injury caused by real MMA fighting. These embodiments of the training mannequin, as a result of blows inflicted by a user, produce metrics for linear motions of the training mannequin along three axes, i.e., x-, y-, and z-axes, and for rotational motions in the three perpendicular planes defined by pairs of these axes, which amounts to motions having six degrees of freedom (DOF).

Embodiments of the training mannequin described herein may be used to educate, demonstrate, and train MMA artists or fighters, boxers, or those engaged in self-defense how to produce an effective "knockout" blow, i.e., a concussion with loss of consciousness to an opponent, or how to otherwise inflict maximum injury to an opponent. In these and other embodiments, blows to the mandible (lower jaw) of the training mannequin, causes rotation of the training mannequin's head, which produces extraordinarily high rotational velocities and accelerations measured in radians/sec (rad/s) and radians/sec$^2$ (rad/s$^2$), respectively. The training mannequin can provide instantaneous feedback to the fighter about where and how hard to strike an opponent to render this knockout punch. Also, these embodiments may be used to teach the efficacy of a head strike, e.g., punching at the optimum location and time to incapacitate the opponent or render them unwilling to continue the match or fight. In addition, embodiments of the training mannequin can bring to light and attention the need to be aware of and prevent head injuries to humans.

Embodiments of the invention incorporate apparatus and methods to produce motion of the training mannequin (e.g., body rotation) that employ motion strategies mimicking human motion used in combat sports. Embodiments of the invention also provide a more accurate objective measurement for brain concussions incurred in combat/contact sports.

Embodiments of the invention include a head or head portion of the training mannequin that is three dimensional and physically integrated with a neck or neck portion and a torso or torso portion or upper body of the training mannequin, forming one seamless humanlike head, neck, and torso. An outer shell or skin of the training mannequin may assume different colors and sizes, depending on design and manufacturing choice. In certain embodiments, this outer shell may be at least two (2) inches in thickness made of material having the same or uniform density throughout, i.e., an isodense material. Moreover, the facial features on the training mannequin may resemble that of an actual human. In certain embodiments, the training mannequin will have a painted hair line, eyebrows, eyes with colored irises, pupils in the center of the irises, eye lashes, and nipples on the front of the torso.

Embodiments of the invention will provide a basis for trainers, referees, judges, ring-side doctors to be more able to predict a serious head strike or blow that will prompt the latter observers, via their laptops and receivers, to interrupt a seriously potential brain concussion. These ringside experts will then be able to perform a mental evaluation of an MMA fighter whenever necessary, and improve the safety of the sport. In similarity, embodiments of the invention may be used to help improve the safety of other contact sports.

DETAILED DESCRIPTION OF THE INVENTION

This application claims the benefit of U.S. Provisional Application Ser. No. 62/320,504, filed Apr. 9, 2016, which is incorporated herein by reference in its entirety.

Figure 1:
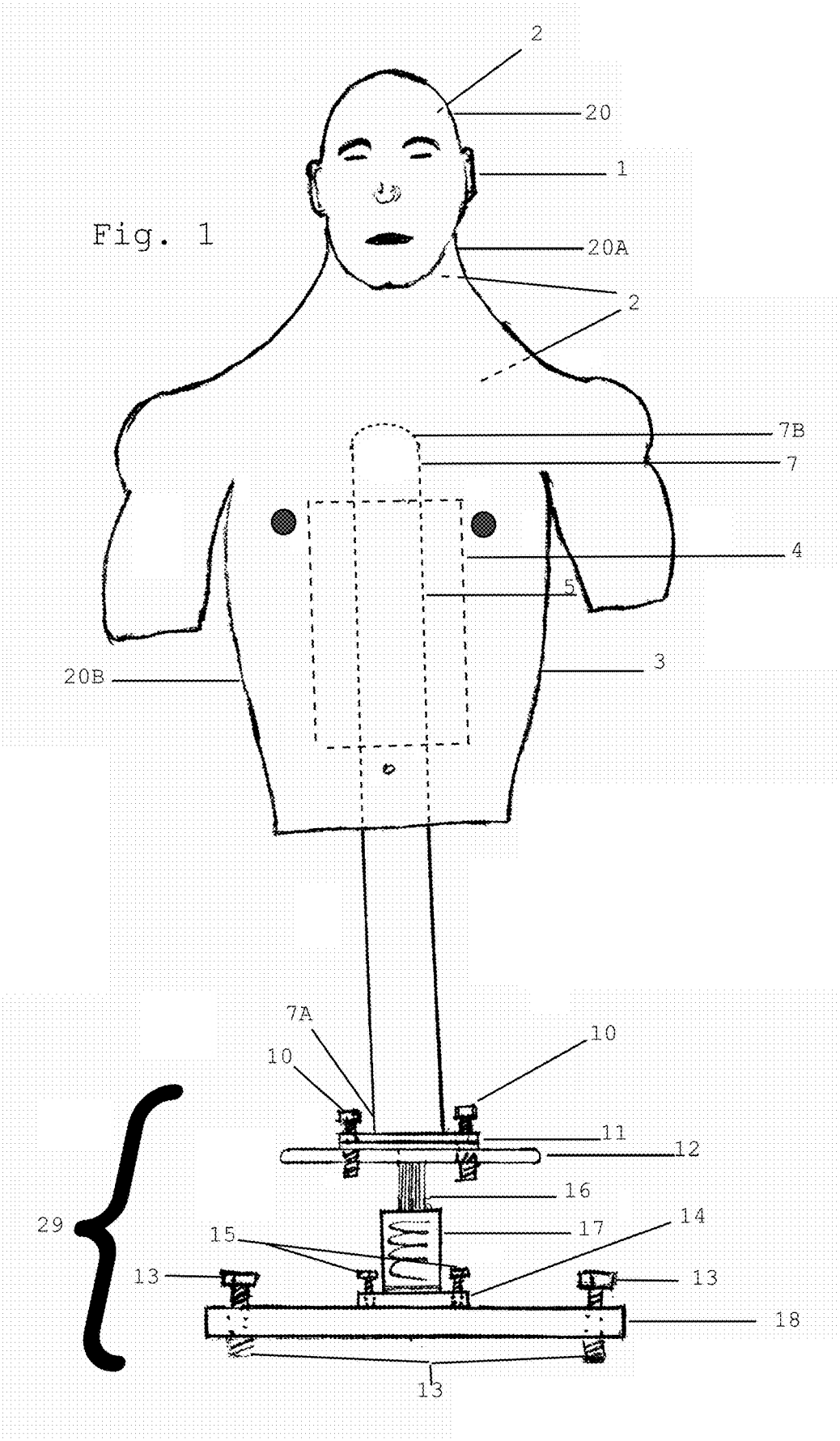
FIG. 1 is a front view of a training mannequin in accordance with an embodiment of the invention.

In accordance with embodiments of the invention, an anthropomorphic surrogate or training mannequin 1, shown in FIG. 1, represents an opposing human fighter, which may be used by a trainee or user to train, for example, for MMA, and/or for predicting concussions. The training mannequin 1 may be either male or female in appearance, and may have various racial or facial features, physical size, and height. The training mannequin 1 has a base 29 that includes a flywheel driven by an electric motor which rotates the training mannequin in a controlled manner anywhere within a rotational range, such as ±90 degrees inclusive (i.e., 90 degrees clockwise or counterclockwise) at varying rotational velocities. In certain other embodiments, the training mannequin can be rotated anywhere through and up to a full 360 degrees of rotation in either clockwise or counterclockwise directions, while allowing for rotational direction reversals and speed changes under programmable control as described herein. The control for these motions is managed by a wireless remote controller device, such as a Bluetooth multimedia remote, a universal or dedicated remote control, a Blumoo™ mobile application running on a smartphone, etc. The directionality and rotational velocity may be varied by the remote controller device, allowing the MMA student to learn footwork as well as how to strike a moving opponent.

Figure 4:
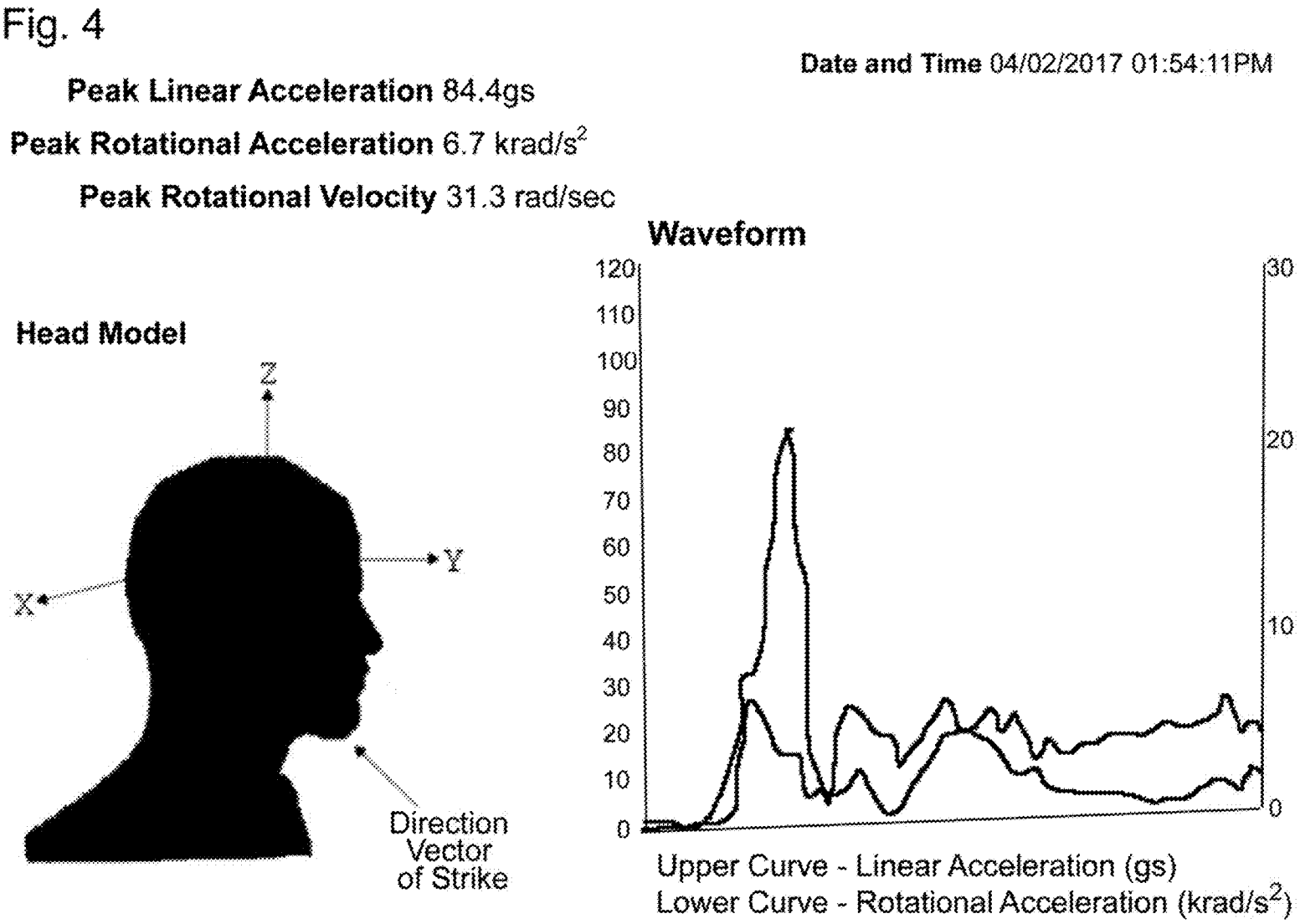
FIG. 4 is a representation of a computer screen showing parameters related to six degrees of freedom measured as a result of strikes to the head of the training mannequin by a user in accordance with an embodiment of the invention.

When the trainee strikes a head 20 of the training mannequin 1 an imbedded acceleration or accelerometer sensor (e.g., a triaxial sensor) located inside the head 20, as will be described further below, transmits instantly or within milliseconds signals that represent triaxial vectors, accelerations, and velocities of the training mannequin as a result of the strike. These transmitted signals are received by a receiving device, which may be portable, such as a computer, tablet, smartphone, controller, or the like. The transmitting technology between the sensor and the portable receiving device may be RF Bluetooth, e.g., for up to and including 100 meters of distance, or WiFi, cellular, or other wireless technology, or, in other embodiments, communications between the sensor and the receiving device may be wired, such as by using USB. All the data collected by the sensor is transmitted to the receiving device for analysis or relayed via the receiving device to an information node using internet technology, such as to a server or computer in the Cloud, for analysis or for distribution to other devices or monitors, if desired. Both hardware and software applications for sensing, transmission, and data display are commercially available, as would be appreciated by one of ordinary skill in the art. Proprietary software may be used to record all body and facial blows to the training mannequin 1 that affect the head embedded with the sensor. The data collected and analyzed by the receiving device or Cloud server can represent both numerical data and a graphic of a human head with the striking vector displayed on a computer screen (e.g., as shown in FIG. 4), such as on the computer screen of the computer 31 in FIG. 10. This graphic may show an arrow pointing to that part of the head 20 of the training mannequin 1 from the direction and general location from which it was struck, as shown in FIG. 4. This information may be used to provide immediate feedback to the MMA athlete or user and/or to his/her trainer.

Triaxial impact sensors are available commercially and have been worn by athletes with the sensor strapped to a head band, taped to the back of the neck, inserted into mouth guards, fitted inside helmets, etc. Although the Department of Defense has performed tests with sensors placed in soldiers' ear canals, present technology does not allow for inserting a triaxial sensor inside a human brain. While these sensor applications are designed to measure human head trauma, they don't lend themselves to training an athlete how to induce head trauma based on using a training mannequin. And although it may be possible to employ one or more of the aforementioned commercial sensor technologies on an MMA human fighter and measure their head trauma, such implementations may be prone to damaging the sensor during actual combat actions incurred in MMA boxing or grappling. Further, MMA athletes would typically not deliberately strike another athlete's head merely for measuring punching effectiveness on the human brain. Both practicality and ethics oppose such an application. On the other hand, striking a human-surrogate training mannequin can only produce injury perhaps to the athlete striking the training mannequin's skull, which may be unbreakable or nearly unbreakable from the forces the athlete is capable of producing. It should be assumed and recommended that the trainee will wear MMA or other boxing gloves to minimize the possibility of hand fractures, as in actual MMA contests.

In accordance with embodiments of the invention, the trainee or user may practice striking the training mannequin's face in very specific areas directed by the trainer while the training mannequin is not moving or held stationary. As training advances, a trainer may stand by with a wireless remote controller that is connected to the training mannequin electric motor to allow the training mannequin to be rotated at various speeds up to and including, for example, 80 revolutions per minute maximum, and/or to be rotated up to and including 90 degrees bilaterally (i.e., rotated anywhere within ±90 degrees in either or alternately in either counterclockwise or clockwise directions when the training mannequin is viewed from above looking down on its head 20). As mentioned above, in certain embodiments the training mannequin can rotate anywhere through 360 degrees in either clockwise or counterclockwise directions. The trainer may control the predictability, random motion, and rotational speed of the training mannequin. In combat sports, one goal of each competitor is to get their opponent to circle into their power hand, while also at the same time circling away from their opponent's power hand. By rotating anywhere within 90 degrees bilaterally the training mannequin 1 will simulate the actual movements that occur in combat sports, where footwork is one of the fundamentals of training. In so doing, the training mannequin 1 will help teach the user or trainee how to best move their feet in both offensive and defensive manners while at the same time measuring the force of each strike landed to the head 20 of the moving (or stationary) training mannequin 1.

Figure 2:
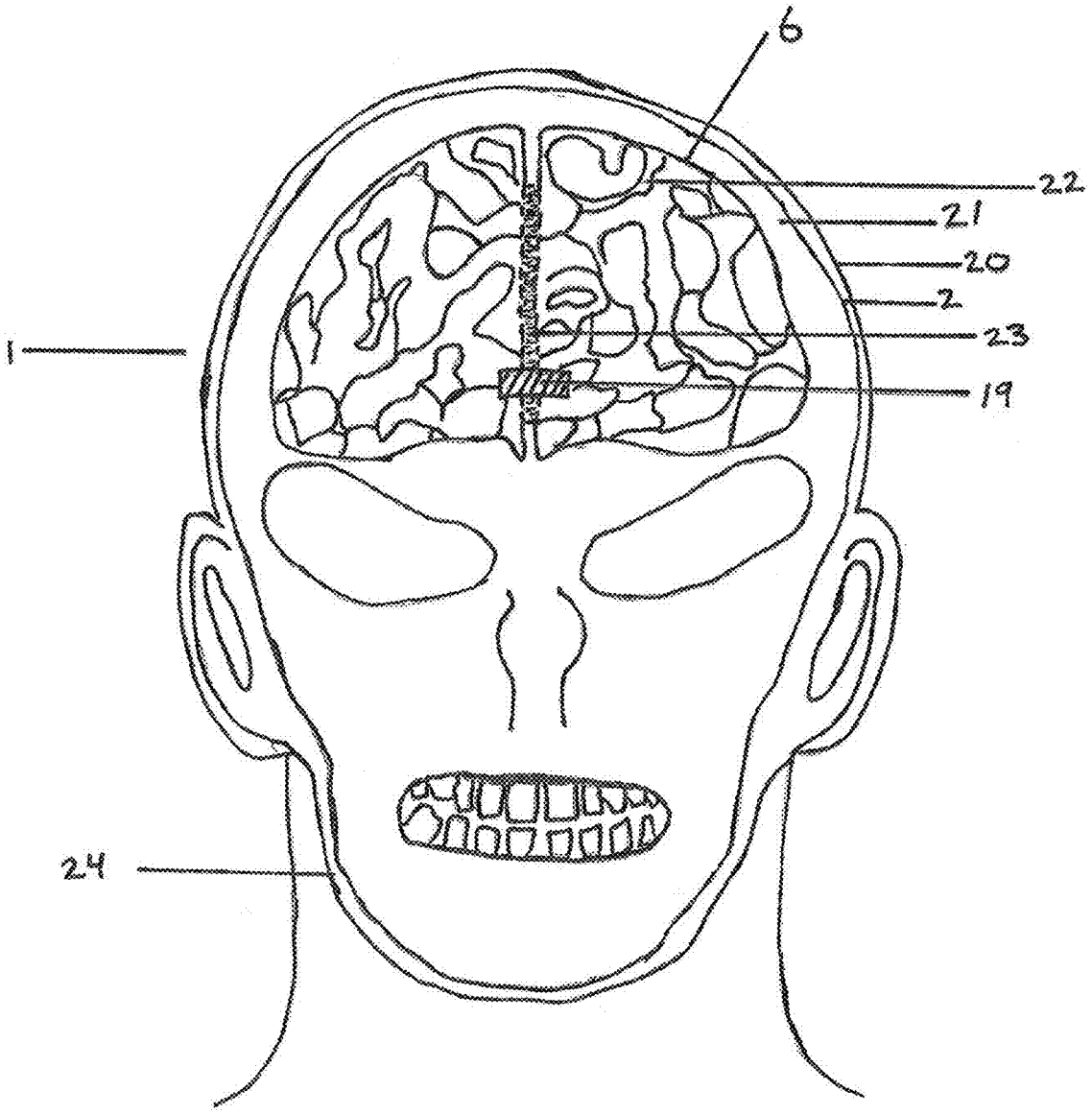
FIG. 2 is a front view of a head portion of the training mannequin of FIG. 1 showing a human-like skull and brain and an accelerometer sensor embedded in a portion of the brain in accordance with an embodiment of the invention.
Figure 3:
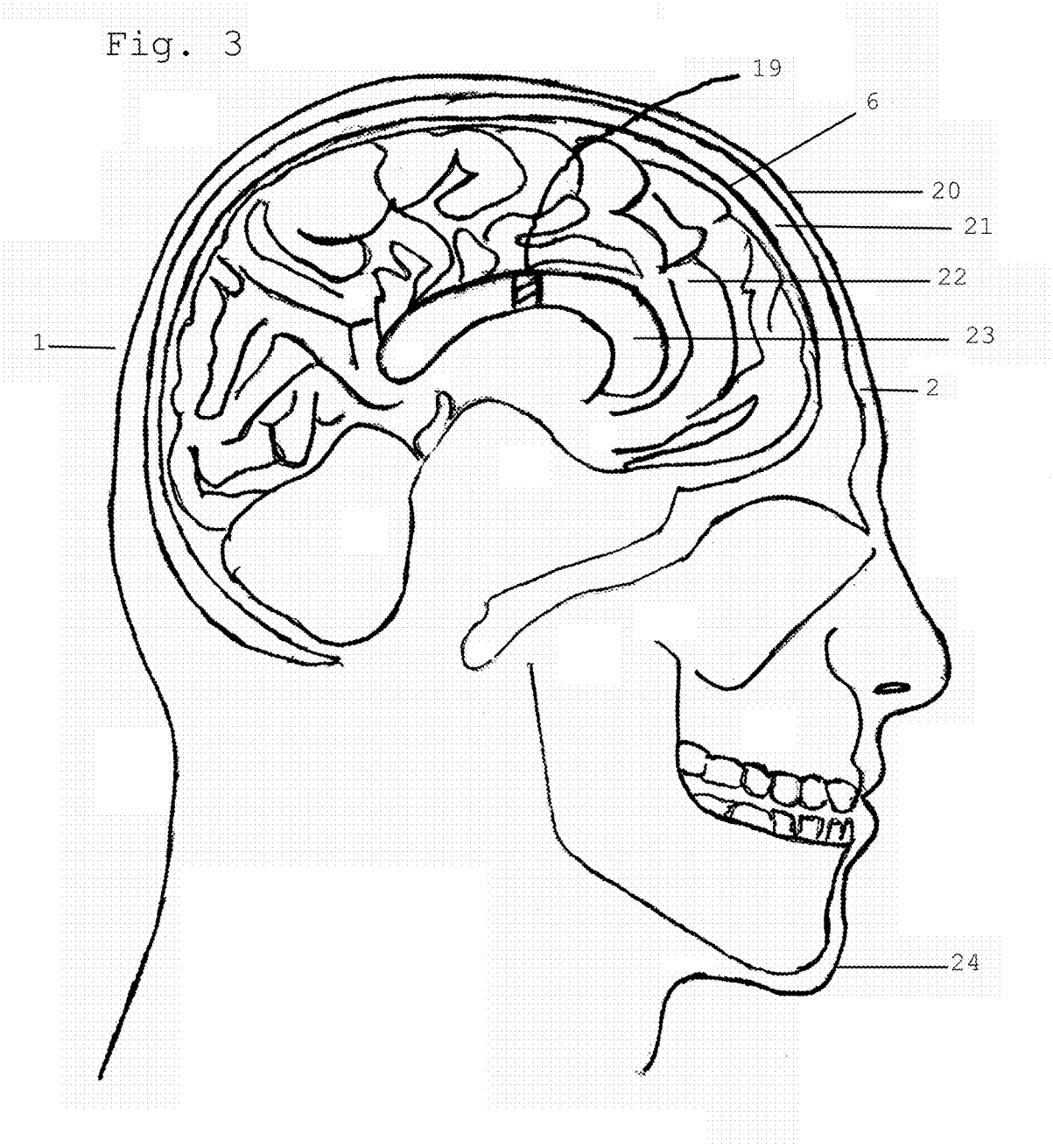
FIG. 3 is a side view of the head portion in FIG. 2 showing the human-like skull and brain and the accelerometer sensor in accordance with an embodiment of the invention.
Figure 9:
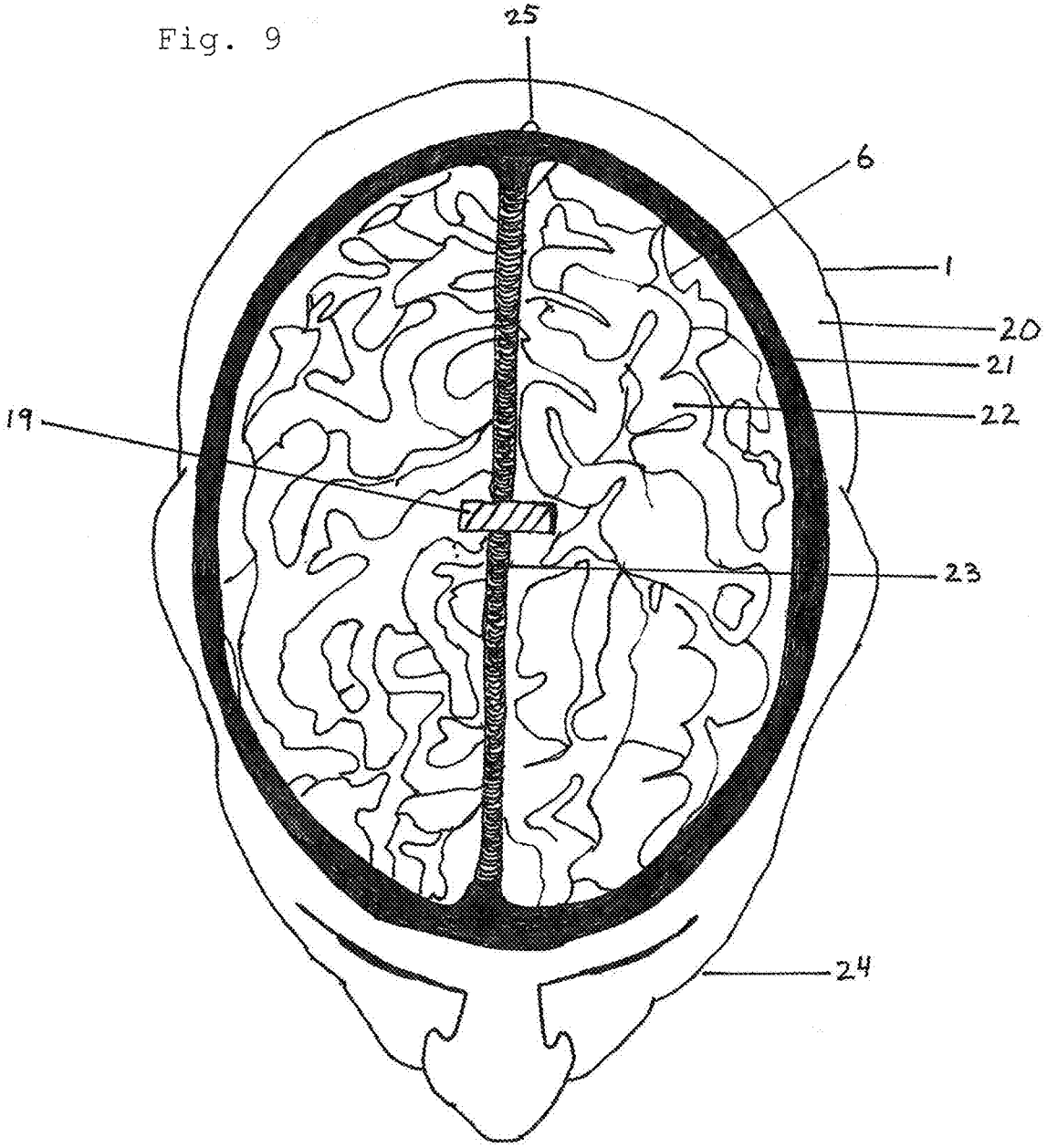
FIG. 9 is a top view of the head portion of the training mannequin of FIG. 1 showing the human-like skull, brain, and accelerometer sensor of FIG. 2 in accordance with an embodiment of the invention.

It will be important for the user to strike the training mannequin at the lower third of the mandible on either side of the head 20 for training and for calibration purposes, as will be described below. This will produce the maximal coronal rotation of the head 20 in the direction predicted to produce maximal axial acceleration and velocity to an anthropomorphic brain 22 and embedded sensor 19 in an interior region 6 inside a skull 21 in the head 20 of the training mannequin 1, as shown in FIGS. 2, 3, and 9. The trainee will learn when, how hard, and exactly where to strike the training mannequin sufficiently to produce the highest axial force (in an x, y, and z, coordinate system centered on the head 20 of the training mannequin 1). This will allow the trainer and trainee to evaluate the trainee's punching technique and effectiveness objectively, and also help the trainer become a better trainer or coach.

In accordance with other embodiments of the invention, the trainee or user is allowed to take complete control of the anthropomorphic training mannequin 1 by programming it to run through a select series of motions, set and initiated by the trainee. Both predictable motions and speeds as well as a random series of rotational motions, angles, and directions may be controlled or influenced by a software or hardware random event generator or controller device (not shown) providing signals to or within, or coupled or connected between the control module, the controller 28, or a computer/smart device and the mannequin's electric motor.

Figure 10:
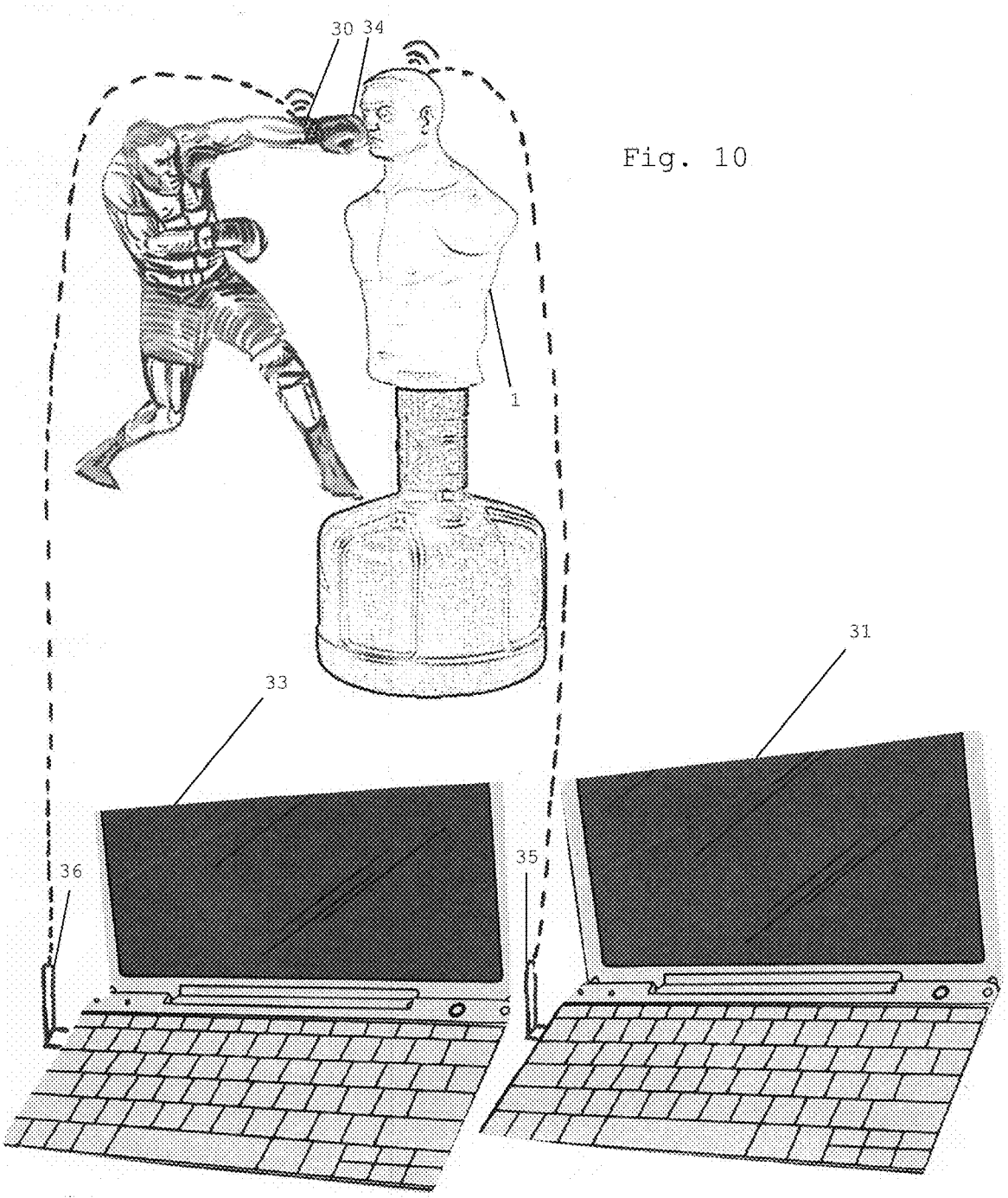
FIG. 10 is an oblique view of the training mannequin of FIG. 1, showing a user wearing gloves, a sensor for one of the user's gloves, and a sensor in a head of the training mannequin, for sensing motion parameters of the user's strikes to the training mannequin from both the glove and the head of the training mannequin, and schematically showing transmissions between the two sensors and two computers.

In accordance with certain other embodiments of the invention, a smart device, such as the computer 31 in FIG. 10, which may be a smartphone as discussed elsewhere herein, may be used to connect to or communicate with a projector to display acquired data such as shown in FIG. 4 or with a monitor or display for the same purpose, such that the trainee or user can easily and immediately view after a strike, with or without the assistance of his/her trainer. This could provide the trainee or user and/or trainer with graphic feedback shown on the display, such as indicating axial deviations of the training mannequin 1 due to strikes and a pointer to where the head was actually struck (see FIG. 4).

In accordance with another embodiment of the invention, the training mannequin 1 is used to help develop the trainee or user's footwork. It is common knowledge in combat sports that proper footwork is important to render an opponent vulnerable to striking blows and various wrestling holds. Since the training mannequin is able to rotate up to 90 degrees clockwise and 90 degrees counterclockwise inclusive (as seen from looking down from above the training mannequin), the trainee will develop, with the assistance of the trainer, the proper foot movements empirically known to enhance the combatant's effect in the fighting ring or elsewhere. The combination of striking the training mannequin's head at a target location, together with requiring the trainee to move from side to side, provides the training which would otherwise require another human opponent with great speed and skill in the training mannequin's place. The training mannequin may be struck with the full force that would otherwise create untoward consequences of injury to a human opponent. Additionally, the trainee may receive feedback on the effectiveness of his/her striking blows to a specific place on the training mannequin's head, ideally the lower third of the jaw or mandible.

Referring to FIGS. 1 and 2, the training mannequin 1 includes the head 20, a neck 20A, and a torso 20B, forming one seamless human-like head, neck, and torso corresponding to real human body parts. The head 20, neck 20A, and torso 20B of the training mannequin 1 have an integrated outer shell (or outer shell material) or skin 3. The shell or skin 3 should be formed from or made from a durable, pliable material, such as latex or a latex-type material. In certain embodiments, the outer shell 3 may have a thickness of at least one-half inch, and may be made in different colors and/or sizes, depending on design choice. The head 20 includes a human-like skull (or skull-like structure) or skull portion 21 located inside or embedded in an interior region 2 inside the outer shell of the training mannequin 1 in the head 20 (the interior region 2 also includes interior regions inside the neck 20A and the torso 20B inside the outer shell 3, as shown in FIG. 1). The skull 21 may be, for example, made of unbreakable plastic, for example, like the 3B Scientific® A20 skull available from American 3B Scientific, 2189 Flintstone Drive, Suite 0, Tucker, Ga. 30084 U.S.A. The interior region 2 outside the skull 21 is filled with a material, such as a polyurethane foam. Located or embedded within the interior region 6 in the skull 21 is a brain or brain-like material 22, e.g., a flexible and/or deformable material, such as a homomorphic gel substance, silicone putty, silicone or molded silicone, or the like. The brain 22 may be embedded or placed within the skull 21 before the skull 21 is embedded or placed within the head 20. The skull 21, the brain 22 with the embedded sensor 19 will allow the user or trainer to more accurately measure, determine, and model the effect the user's strikes could have within the brain of an actual human being. Plus, embodiments of the training mannequin 1 allow the user to sense, in some ways, what it feels like to strike another human being without actually having to strike a real person.

The accelerometer sensor 19 shown in FIGS. 2, 3, 7, and 9 is placed or embedded within the brain 22 in the skull 21 at a location or position in a region 23 (shown schematically as a hashed region in FIGS. 2 and 9) generally at or near the center or middle of the brain 22 that is meant to be representative of being in the corpus callosum of the real human brain useful for measuring concussive forces from trainee punches, as will be described below. The region 23 shown in FIGS. 2 and 9 is not a structure in the brain 22 of the training mannequin 1 that joins anything. It is just a location or position indicator. Such construction, using these components and materials, serves to provide a more realistic and accurate model using signals related to motion of the sensor 19 in the brain 22 due to strikes by the trainee or user for assessing the damage, injury, and trauma that would occur to a real human brain subjected to such strikes.

The sensor 19 may be, for example, a Triax SIM-G or SIM-P sensor manufactured by and available from Triax Technologies, Inc., 66 Fort Point St., Norwalk, Conn. 06855. Such sensors contain a 3-axis high-G linear accelerometer, which can measure 3 to 400 Gs, and a 3-axis gyroscope, which measures the rotational acceleration of each impact. When the user strikes a face 24 of the mannequin 1, the sensor 19 detects or senses motion of the training mannequin 1 due to the blow and sends corresponding radio frequency (RF) signals to an RF receiver (not shown) for or located in a computer (shown as computer 31 in FIG. 10), such as a laptop computer, PC, tablet, or smartphone (hereinafter "computer") that picks up the RF signals generated by the sensor 19 through an antenna (shown as antenna 35 in FIG. 10) In other embodiments, the signals corresponding to the blow may instead or also be sent as electrical or electronic signals via wires or a bus, such as via a USB connection to a receiver in or associated with the computer 31 for receiving the electrical or electronic signals. Such signals associated with the blow are transmitted (immediately after the blow or very soon thereafter, such as within milliseconds) to the RF receiver, processed by the computer to ascertain the force of the blow to the head 20 and other associated parameters, such as accelerations, velocities and motion vectors, as will be described in more detail below, to be represented on the computer's viewing screen, an example of which is shown in FIG. 4. Software, such as Triax's software for its sensors, stored and executed in the computer or in the web-based Cloud, controls storage of the motion vectors, accelerations, velocities, etc. associated with the forces of the user's strikes to the training mannequin in the computer, the Cloud, or elsewhere, allowing the user or a trainer to immediately or very quickly read the results of the head strikes.

Figure 5:
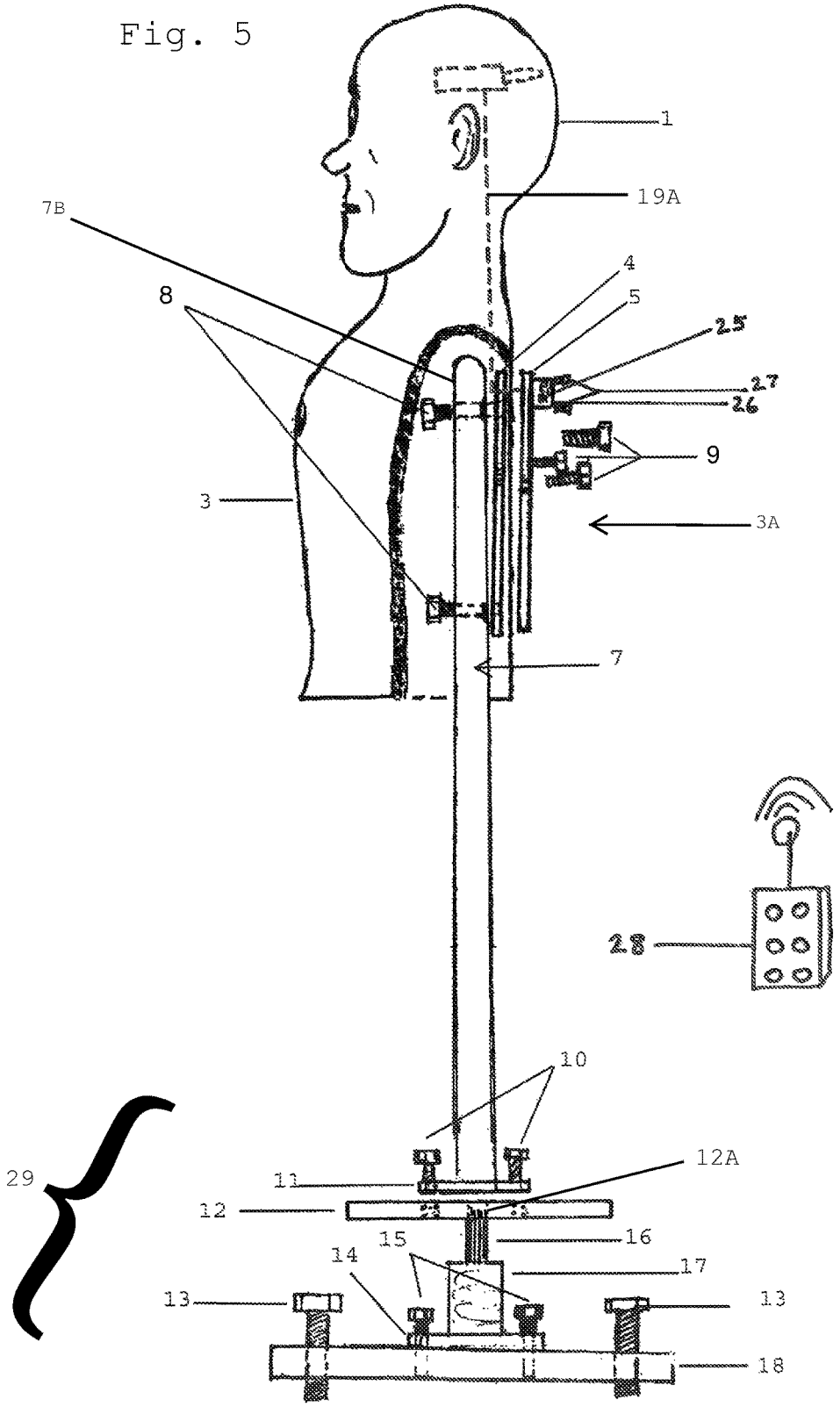
FIG. 5 is a side view of the training mannequin of FIG. 1 in accordance with an embodiment of the invention.
Figure 6:
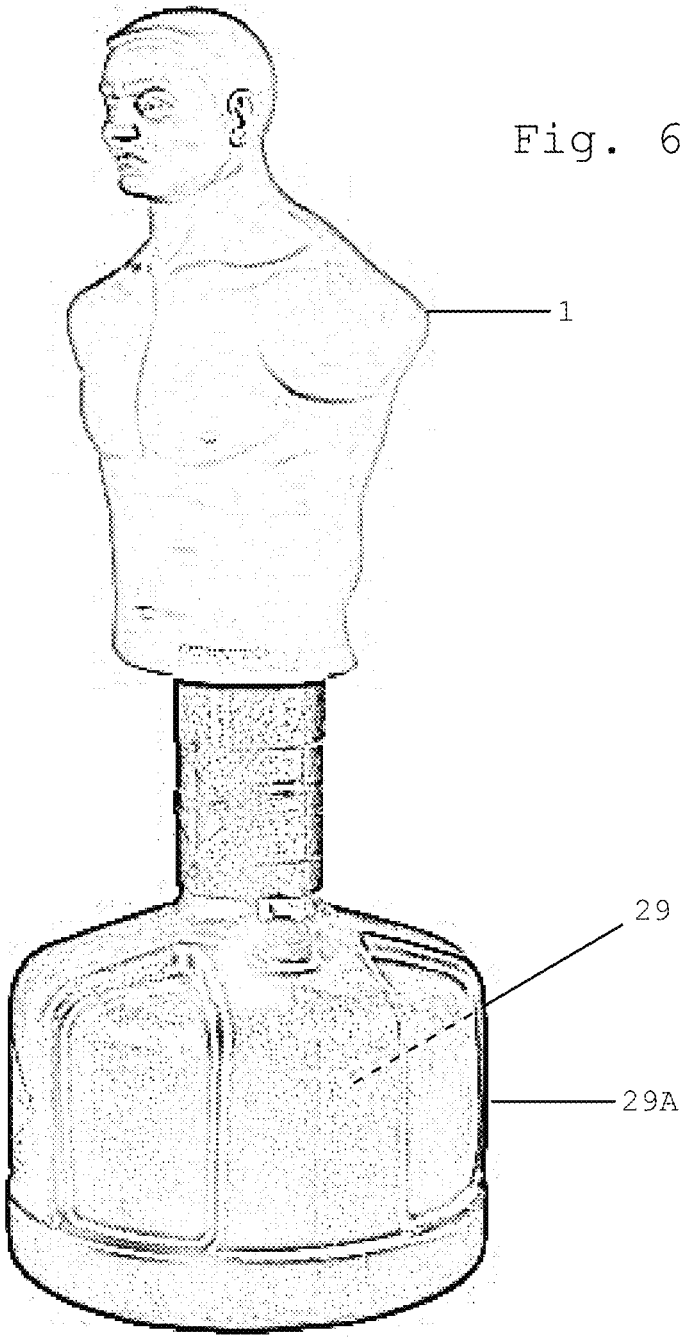
FIG. 6 is an oblique view of the training mannequin of FIG. 1 in accordance with an embodiment of the invention.

The training mannequin 1 includes additional structural and drive components that aid in training fighters or users by producing the mechanical motion of the training mannequin 1 to mimic the motion of a real opponent or to present certain positions of the training mannequin 1 with respect to the user. As shown in FIGS. 1, 5, and 6, embodiments of the training mannequin 1 also include a flywheel 12, as described above, located within a base 29, which besides the flywheel 12, includes other structural and drive components of the training mannequin 1. The base 29 may include an exterior housing 29A (shown in FIG. 6), which may be made of plastic or metal, for protection of the components of the base 29 enclosed or located within the housing 29A. The base 29 is indicated schematically by the curly brackets in FIGS. 1 and 5. These other structural and drive components of the base 29 are described in more detail below.

The flywheel 12, when driven under programmable control of an electric motor 17, rotates the training mannequin 1. The programming may cause the training mannequin 1 to rotate within a certain angular range in the plane of the flywheel 12, as described above, such as within and inclusive of 180 (e.g., up to ±90 degrees) or within and inclusive of ±360 degrees. Depending on the programming, the rotation may be at a set angular velocity in one direction and when an angular limit is reached the direction of rotation reverses, etc., or the rotational motion could vary in angular velocity randomly or reverse direction randomly or such changes could occur at set angular or time intervals. Control of the rotational movement of the training mannequin 1 will be described in more detail below. Such motions are meant to represent or mimic the footwork of a real opponent as a model of MMA or other fighting. The motion of the training mannequin 1 may thus encourage or help train the user to work on, change, modify or improve his/her own footwork and other motions while maneuvering about the training mannequin 1 as it rotates under programmable control. The training mannequin 1 may also be used to train the user while it is stationary.

Figure 8:
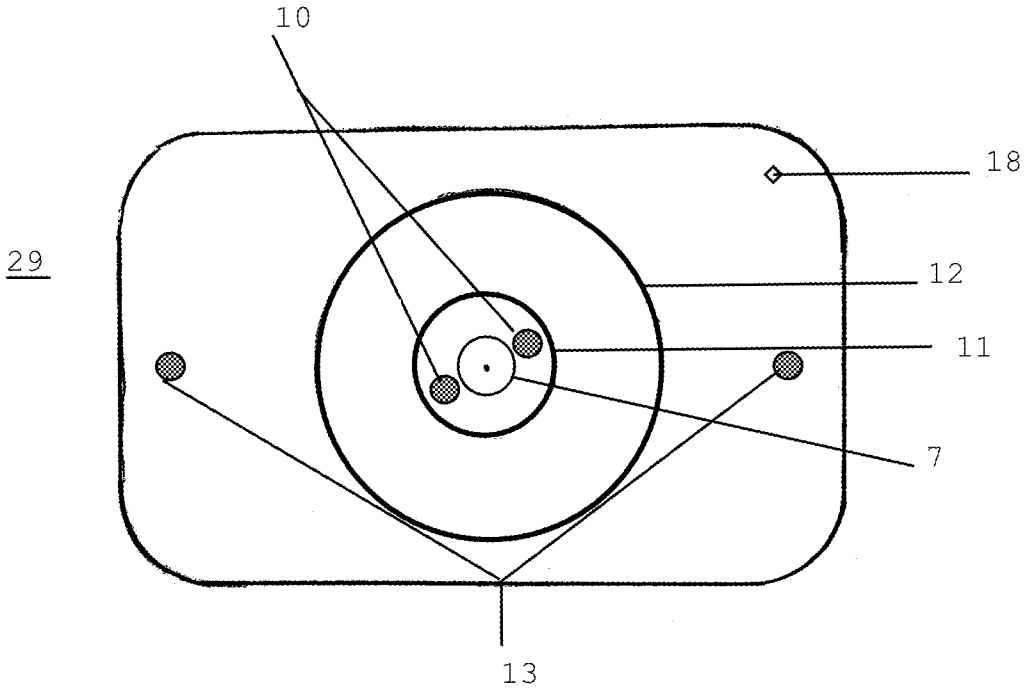
FIG. 8 is a view of a portion of a base of the training mannequin of FIG. 1 as if looking down from above the head of the training mannequin, but with the head, neck, and torso of the training mannequin not shown, in accordance with an embodiment of the invention.

The structural and drive components of the base 29 of the training mannequin 1 are also shown in part in FIG. 8. The view in FIG. 8 is as if looking downward on the base 29 from above the head 20 of the training mannequin 1 (i.e., toward the floor on which the training mannequin 1 is placed), but with the housing 29A and everything else but these structural and drive components of base 29 not shown. These structural and drive components further include, in part, a drive shaft or rod 7, a hub plate 11, and a motor shaft 16. A lower end 7A of the drive shaft 7 is welded or otherwise affixed to the hub plate 11. An upper end 7B of the drive shaft 7 is disposed within the interior region 2 within the material, such as polyurethane foam, that is inside the training mannequin 1, as shown in FIGS. 1 and 5. In certain embodiments, the lower end 7A of the drive shaft 7 is affixed to the hub plate 11 by splines on the exterior of the drive shaft 7 that are inserted into an internally splined opening or coupler (not shown) located in a central region of the hub plate 11, as would be appreciated by one of ordinary skill in the art. The hub plate 11 is fastened to the flywheel 12 in a centrally located area of the fly wheel 12 using, for example, bolts 10, such as one and one-half inch long coarse bolts, that are tightened through pre-threaded and pre-aligned screw holes in the hub 11 and the flywheel 12. This arrangement will allow the flywheel 12 to rotate the drive shaft, as described above, when the electric motor 17 (FIG. 5) is activated by programmable control, as will be described further below.

The flywheel 12 also includes a coupler or an internally splined opening 12A for receiving a motor shaft 16 of the electric motor 17. The motor shaft 16 may also be externally splined. External splining of the motor shaft 16 allows the motor shaft 16 to lock into the internal splined opening 12A of the flywheel 12, which allows the motor 17 to manipulate the movement of the flywheel 12 and thus the movement of the training mannequin 1 as one unit.

The electric motor 17 is positioned on the opposite side of the flywheel 12 than the hub plate 11, as shown in FIGS. 1 and 5. The motor 17 includes a motor hub mounting plate 14 that is mounted to a floor mounting plate 18. Bolts 15, such as five-sixteenth inch diameter bolts, may be used to mount the motor hub mounting plate 14 to the floor mounting plate 18. The floor mounting plate 18 itself may sit on or be mounted to the floor or ground (and possibly leveled) by at least three bolts 13, such as two-inch long seven-sixteenth coarse bolts. In other embodiments, a floor-implantable and pre-threaded base (not shown) may instead be used to mount the motor hub mounting plate 14. In this way, the training mannequin 1 will be held securely in place on the floor or ground while the electric motor 17 is able to rotate it, for example, depending on the embodiment, up to and including ±90 degrees or ±180 bilaterally (i.e., anywhere through 180 (±90) degrees or anywhere through 360 (±180) degrees, respectively) because the electric motor 17 can reverse the rotation direction of the drive shaft 7 under programmable control) and will be able to absorb head and body strikes from the user or trainee without toppling over. Connecting these structures and components as described also will allow the training mannequin 1 to move as smoothly or fluidly as possible.

The motor may be controlled by a remote controller having wireless (shown as a remote controller 28 in FIG. 5) or wired (not shown) communications capabilities. The wireless controller 28 may have RF communications capabilities, Bluetooth communications capabilities, or the like, or may have a combination of both capabilities. The remote controller 28 may also be part of the computer that receives the signals from the sensor 19, as described above and shown as the computer 31 in FIG. 10. The motor 17 may be, for example, a one-horse power (1 HP) A/C electric motor, which is small enough to be concealed, along with the other components of the base 29, within the base housing 29A and out of the user's or trainee's way, yet of sufficient size not to be affected by strikes to the training mannequin 1 while in motion or stationary. In certain embodiment, the RF controller 28 may be set to keep the training mannequin 1 stationary or to move it within or through 90 degrees bilaterally or within or through 180 degrees bilaterally, e.g., every four seconds in a continuous motion, or some start and stop motions or other possible variations of speed and rotational motion that may be programmed, as discussed above. Alternatively, another person, such as a trainer, may control the motion of the training mannequin 1 to vary its speed and direction for the user, thereby making the user guess which direction the training mannequin 1 will move next and at what speed, as if in an actual fight or combat.

Figure 7:
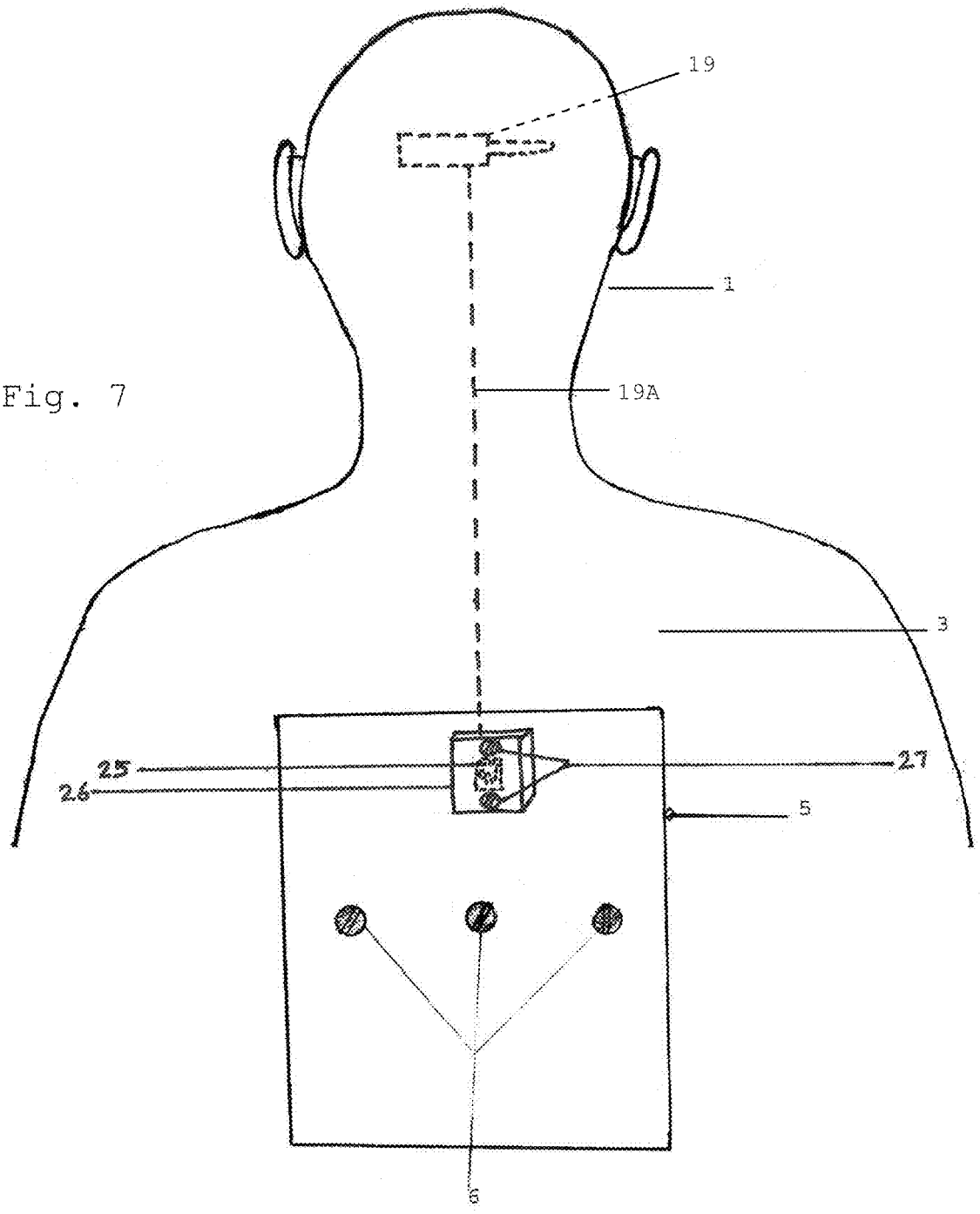
FIG. 7 is a back view of a portion of the training mannequin of FIG. 1 in accordance with an embodiment of the invention.

Referring again to FIGS. 1 and 5, to controllably move the torso 20B of the training mannequin 1, the drive shaft 7 is physically coupled or connected to an internal mounting plate 4 inside the torso 20B. For example, bolts 8, such as two and one-half inch long coarse bolts, may be inserted through pre-threaded and pre-aligned screw holes in the drive shaft 7 and the internal mounting plate 4 (FIG. 5) and tightened to affix the drive shaft 7 to the mounting plate 4. As shown in FIGS. 5 and 7, an external mounting plate 5 may be placed in contact with the shell 3 at a back side 3A of the torso 20B and aligned with the internal mounting plate 4 such that other pre-threaded and pre-aligned screw holes in the plates 4 and 5 line up for coupling or connecting the plates 4 and 5, for example using bolts 9, which may also be two and one-half inch long coarse bolts, that are tightened. In this manner, part of the back side 3A of the torso 20B that includes part of the shell 3 and the elastic fill material of the training mannequin 1 will be sandwiched and compressed between the two plates 4 and 5, such that the torso 20B of the training mannequin 1 is securely held to both the drive shaft 7 and the internal mounting plate 4. The fill material inside the torso 20B, in addition to the shell 3, provides shape and mass to the training mannequin 1. The fill material should be of sufficient compressibility and strength to be sandwiched between the plates 4 and 5 and keep itself and the torso 20B intact as the training mannequin 1 rotates, and also it should be of sufficient density and elasticity to be able to absorb strikes from the user and return and recover to its original form/position as if the user were striking a real person generally. A material, such as an elastic material like polyurethane foam, may be used for the fill material.

By use of these couplings and connections, along with the others described above, the training mannequin 1 will remain in an upright or "standing" position as if it were an opponent in front of the user in actual competition or combat while the training mannequin 1 can be rotated when the electric motor 17 is activated to move the flywheel 12. The electric motor 17 may be controlled to reversibly rotate and drive the training mannequin anywhere within its bilateral rotational motion under the programmable control of the computer 31 or the controller 28. Such motion, in turn, allows the user to work on and practice his/her footwork while accommodating and reacting to the position of the training mannequin 1 as if in a real competition or combat.

In certain embodiments, a trainee or user may desire to train with the training mannequin 1 stationary or only rotatable through a particular angle of rotation (e.g., ±45 degrees) less than the maximum rotatable angle (e.g., ±90 degrees) with the motor 17 deactivated. In these embodiments, to keep the training mannequin stationary when the trainee or user strikes the training mannequin 1, a pin may be removably inserted from underneath the training mannequin 1 into a hole in the floor mounting plate 18 or otherwise have a lower end of the pin affixed to the floor mounting plate 18, and an upper end of the pin is removably inserted vertically into a corresponding hole in the flywheel 12 located near the outer radius edge of the flywheel 12 (not shown), as would be understood by a person of ordinary skill in the art. The pin should fit snuggly into both holes or may include a threaded nut (if the upper end of the pin is threaded) or other fastener tightened or attached to the upper end of the pin to hold the pin in place vertically through both holes or through just the one hole in the flywheel 12 if the lower end of the pin is already affixed to the floor mounting plate 18. In certain others of these embodiments, with the motor 17 deactivated, to allow the training mannequin 1 to only rotate through a particular angle smaller than the maximum rotatable angle when the trainee or user strikes the training mannequin 1, a similar mechanism may be used. In these embodiments, instead of using a hole in the flywheel 12 for removably inserting the upper end of the pin, a curved slot is used (not shown). The slot is located near the outside radius edge of the flywheel 12 and has a curvature that is concentric with the outer radius edge of the flywheel 12. The slot may extend over an angle, for example, 180 (±90) degrees, in the plane of the flywheel 12 or may extend to more or less of an angle than 180 degrees. The upper end of the pin may be removably inserted into the slot from below, as similarly described above. Two bumpers, such as rubber bumpers, also may be inserted into or kept in the slot such that the upper end of the pin is inserted between the bumpers. The bumpers may be kept in the slot using keepers or grooves in the bumpers that prevent the bumpers from popping out of the slot. The bumpers will have attached thereto bolts, screw mechanisms, or other fasteners that may be removably tightened or secured to the edges of the slot or through other holes in the flywheel 12 located outside the outer edge of the slot and/or inside the inner edge of the slot, as would be understood by a person of ordinary skill in the art. The bumpers are used to stop the pin as it traverses laterally along the curved slot in the plane of the flywheel 12 when the trainee or user strikes the training mannequin 1. The size of the angle the training mannequin 1 may rotate upon such a strike can be controlled by adjusting the position of the bumpers within the slot relative to each other. This involves untightening the bumpers and sliding them within and along the slot, as appropriate, to define the desired and allowed angle that the training mannequin 12 may rotate through upon being struck and then retightening the bumpers to the flywheel 12 using their fasteners described above. In alternative embodiments, one of the bumpers may be permanently fixed in position within the slot and the position of the other bumper along the slot may be as just described. Thus, in these embodiments, the pin prevents the flywheel 12 and therefore the training mannequin from rotating or only allows it to rotate over a set angle when the training mannequin 1 is struck by a user with the driving motor 17 turned off.

Referring now to FIGS. 5 and 7, in certain embodiments, the sensor 19 includes two wires 19A that extend from the brain 22 of the training mannequin 1 down the interior of the mannequin's torso 3 to a battery 25 (e.g., a rechargeable 9-volt battery) that may be located on the plate 5 inside a retaining cover 26 attached to the plate 5 using, for example, two screws 27 inserted into and tightened with pre-threaded holes in the plate 5 (not shown). The battery 25 provides power (i.e., voltage and/or current) to the sensor 19 for its operation. In other embodiments, the battery may be located elsewhere in or on the training mannequin as long as it does not interfere with its rotation or with the user's ability to strike the training mannequin 1, as would be understood by one of ordinary skill in the art. In alternative embodiments, the sensor 19 could be powered (i.e., provided with voltage and/or current for its operation) using an appropriate electrical transformer electrically coupled to the AC power source of the electric motor 17 (not shown), or in other embodiments the battery 25 could be recharged through a suitable transformer electrically coupled to the AC power source of the electric motor 17 (not shown), as also would be understood by one of ordinary skill in the art.

Referring to FIGS. 2, 3, and 9, the location of the accelerometer sensor 19 in the brain 22 is strategic for measuring the effects that strikes have on the brain 22 as a model and substitute for the potential effects on the real human brain. This is because the accelerometer sensor 19 is placed within the region 23 in the brain 22 of the training mannequin 1 that corresponds approximately to a position within the corpus callosum. When a real human head is rotated at high speed and rattled from a strike to the face or head, diffuse axonal injury may occur within the corpus callosum, which can result in a concussion or worse. Human brain matter is a thinly viscous medium that has a gelatinous-like consistency similar to the Jello food product. If a sensor like the accelerometer 19 actually were embedded in a real human brain, more than likely a strike to the head would cause the sensor to become displaced from its original position and possibly rip through the real brain matter. The inventors therefore chose, for certain embodiments, to use a silicone or silicone-like material molded for the brain 22, as a model for the real human brain, but that would hold the sensor 19 in place. Such material will hold the sensor 19 in place and allow the user to obtain information on the effects that their strikes would potentially have on the corpus callosum.

Embodiments of the invention can provide measurement and analysis of up to and including six (6) degrees of freedom (DOF) of motion of the training mannequin 1 as a result of the user's strikes. Analysis of this motion takes into account the rotational motion of the training mannequin 1, whatever that motion is programmed to be, and whether the motion is towards or away from the direction of the user's strikes to the training mannequin 1. Such strikes may include fist punches, kicks, or other impacts to the training mannequin 1, and particularly to the head 20 of the training mannequin, such as to its jaw or mandible. More specifically, these embodiments analyze and measure vectors having components in three (3) linear DOFs, i.e., for linear velocities and accelerations (in meters/sec and meters/sec$^2$, respectively) having components thereof along the x, y, and z axes schematically shown in FIG. 4, plus in three (3) rotational DOFs, i.e., for rotational or angular velocities and accelerations (in radians/sec (rad/s) and radians/sec$^2$ (rad/s$^2$), respectively) (see FIGS. 1 and 5) having components thereof in planes defined by pairs of these axes, as would be understood by one of ordinary skill in the art. These types of motions and forces from strikes, if of sufficient magnitude and depending on their direction, are known scientifically to cause loss of consciousness in a real opponent, and as the inventors hypothesize, are due to their effects on the real corpus callosum, as described above. These effects can translate into a knockout or a technical knockout, i.e., a "win," for the MMA or other type of fighter.

The accelerometer sensor 19 provides the signals related to parameters for these six DOF used for analysis of the motion of the training mannequin 1 due to and to assess the effectiveness of the user's strikes. When the user strikes the head 20 of the training mannequin 1, these signals are transmitted carrying data from the brain sensor 19 to the computer 31 for recording measurements and analysis of the speed of the strike, the strike vector (magnitude and direction) where the user has landed the strike, the velocity of the strike (e.g., the speed in any direction the head 20 moves when impacted), the force of the strike (e.g., the impact measured in G-forces), the imparted angular acceleration of the training mannequin 1, etc. These parameters may be displayed on a screen or display of the computer 31 or server (see FIG. 4), which may be a laptop, tablet, smartphone, or the like, based on analysis or analyses performed by the computer 31 or in the Cloud, in accordance with embodiments of the invention.

The signals from the accelerometer sensor 19 can be used to establish a tolerance curve(s) that is (are) correlated to known or measured diffuse axonal injuries in real human beings. For this process, the user may level strikes to the head 20 of the training mannequin 1 while the training mannequin 1 is rotating, e.g., when it is under programmable control to rotate through its entire bilateral ±90 degrees, as described above. This would allow the force of the strikes to be recorded, measured, and analyzed from the signals transmitted by the sensor 19 while the training mannequin 1 is rotating away from an incoming strike of the user and/or rotating directly into a strike, which causes more force to the head 20. The user also may strike the head 20 of the training mannequin 1 to obtain, record, measure, and analyze signals transmitted from the sensor 19 when the training mannequin 1 is stationary. All of these data could be used to establish the tolerance curve(s).

Specifically, a user or trainer, or other person may record measurements and an average determined, using the computer 31 or a server in the Cloud, for these parameters associated with the user's strikes or series of such strikes of different strengths or forces for a particular training mannequin 1 ("training mannequin parameters"). These training mannequin parameters may be used to develop or update the tolerance curve(s) by calibration and/or correlation against current or future known, recognized, or tested real human parameter values that produce damaging effects from rotation or rattling of the real human corpus callosum due to strikes or other forces. The training mannequin parameter values may be determined by measurements where the user's particular training mannequin 1 is located or in a laboratory environment for a series of such strikes under test conditions. Such calibrations and/or correlations may also or instead be performed for mass-produced training mannequins like the training mannequin 1 prior to sale in which such a tolerance curve(s) is (are) pre-programmed into controller(s) like the controller 28 (or like the computer 31) for the mass-produced training mannequin(s).

In accordance with other embodiments of the invention, a second accelerometer sensor 30 (and its battery or other power source), which is like the sensor 19, may be placed or located in a wrist area of a boxing or MMA glove 34 (shown in FIG. 10). The user can strike the head 20 of the training mannequin 1 and both sensors 19 and 30 can send signals wirelessly or wired, or both, depending on the particular embodiment, as described above for the sensor 19 and also below, to the computer 31 and a second computer 33, respectively. The computer 33 may be like the computer 31, i.e., it may be a laptop, a PC, a tablet, a smartphone, or the like. The information or data obtained from these signals could be stored in memories in the computers 31 and/or 33 or stored on a server's memory or other memory in the Cloud. This information or data would be available to the user or a trainer or owner of the training mannequin 1 for analysis, downloading, observing, printing, generating correlations, training, etc.

The signals received from the sensor 30 in the glove 34 due to the user's strikes to the training mannequin 1 could be used to provide data signals to the computer 33 for analysis related to motions in six DOF of the glove 34 similar to the six DOF described above for motion of the training mannequin 1, but to determine glove parameter values also similar to those described above, i.e., for rotational/linear accelerations, rotational/linear velocities motion vectors, speeds, etc. of the glove 34. Analyses of the signals from both sensors 19 and 30 respectively received by the computers 31 and 33 (like the analyses described above performed by the computer 31) may be performed by one or both the computers 31 and 33 to calibrate or correlate these motions against each other for training the user. The signals from the sensors 19 and 30 also can be used to establish correlations between the readings of both sensors 19 and 30 so that the motion and forces of the glove 34 from strikes to the training mannequin 1 can also be used to predict the effects of these strikes that would cause or be correlated to known, measured, or predicted diffuse axonal injuries in the real human corpus callosum. In other words, these signals and the computers 31 and 33 could be used to determine a tolerance curve(s) similar to those described above.

In the particular embodiment shown in FIG. 10, when the user strikes the head 20 of the training mannequin 1, the sensors 19 and 30 each transmit wirelessly the signals described above (shown schematically in FIG. 10 by dashed lines) that are received by antennas 35 and 36 electrically and/or electronically coupled, such as via USB ports, to their respective computers 31 and 33. The antennas 35 and 36 in certain embodiments may be located inside the computers 31 and 33 and be electrically and/or electronically coupled to the processors or other components in the computers 31 and 33 used to interpret the received signals. Typically, but not always, embodiments of the training mannequin 1 that would allow a full 360 or greater rotation of the training mannequin 1 would use wireless communications between the sensor 19 and the computers 31 and/or 33. In other embodiments, the computers 31 and 33 may each be wired directly to the sensors 19 and 30, respectively, without needing to use antennas (or one could be wired and the other wireless). Such wired electrical connections could be established, for example, using USB wires, connectors, or ports located within or on the training mannequin 1 and/or within or on the glove 34, and using corresponding components external to the training mannequin 1 and/or external to the glove 34 to connect to respective USB ports on the computers 31 and 33. In such wired embodiments, care would have to be taken so that the external wires would not interfere with the user's motion and striking the mannequin 1 or with the motion of the mannequin 1 itself. This could be accomplished, for example, by: (i) allowing plenty of slack in the wires; (ii) the wires to/from the glove 34 being attached to and directed along the user's arm with the hand wearing the glove 34 up to the user's shoulder and then directed to the computer 33; and (iii) having those wires to/from the training mannequin 1 located, attached to, or held near or on the back 3 of the training mannequin 1 (e.g., on the plate 5) and then directed to the computer 31, for example, from under a mat placed underneath the training mannequin 1, as would be understood by one of ordinary skill in the art.

In other embodiments, the user may wear two gloves like the glove 34, each glove having a sensor like the sensor 30 for providing signals to the computer 33 for similar use as described above for the single sensor 30 and the computer 33. In yet other embodiments, a single computer like the computers 31 or 33, or a server or computer in the Cloud may be used instead of the two computers shown in FIG. 10 to receive and analyze the data signals from both of the sensors 19 and 30, or to receive and analyze the data signals from the sensor 19 and from both of the sensors like the sensor 30 if the user wears two gloves each having such a sensor.

Embodiments of the invention described herein may employ many existing commercial-off-the-shelf (COTS)

solutions, e.g., components, but does not exclude developing and manufacturing new technologies or components to replace the COTS parts.

Embodiments of the invention described herein also may have applicability in a game or competition industry format, for example using a training mannequin in competitions to score points for landing the most effective punch or punches known to inflict serious injury to humans in MMA, such as a knockout punch, as if real humans were involved. These applications might involve factors like area of strike, force of punch, and number of strikes per an arbitrary period of time. The user will be able to compare their strike effectiveness by reading the statistics of each punch with computer analysis of the accelerometer sensor's or sensors' data.

Embodiments of the invention described herein further may be employed in other applications, such as for other contact sports for modeling head injuries. Examples of these sports include, but are not limited to, football, rugby, basketball, lacrosse, hockey, soccer, baseball, and boxing.

The specific embodiments described above are merely exemplary, and it should be understood that these embodiments may be susceptible to various modifications and alternative forms. Any structures, components, or process parameters, or sequences of steps described and/or illustrated herein are given by way of example only and can be varied as desired. For example, for any steps illustrated and/or described herein that are shown or discussed in a particular order, these steps do not necessarily need to be performed in the order illustrated or discussed. The various exemplary structures, components, or methods described and/or illustrated herein may also omit one or more structures, components, or steps described or illustrated herein or include additional structures, components, or steps in addition to those disclosed. It should be further understood that the claims are not intended to be limited to the particular embodiments or forms disclosed, but rather to cover all modifications, equivalents, and alternatives falling within the spirit and scope of this disclosure.

What is claimed:

1. A training mannequin comprising:

a durable pliable outer shell for forming a shape of an upper portion of a human body;

an elastic material for providing shape and mass to the training mannequin disposed within the outer shell;

a skull-like structure disposed within the elastic material;

a deformable material disposed within the skull-like structure; and a motion detecting sensor disposed within the deformable material in a region that represents a corpus callosum in a real human;

a motor coupled to the upper portion, wherein the motor is for imparting rotational motion to the upper portion upon activation of the motor under programmable control, the rotational motion chosen from being:

(i) at predictable speeds or at random speeds, or (ii) over predictable rotational angles or over random rotational angles, or (iii) predictable clockwise motion, random clockwise motion, predictable counterclockwise motion, random clockwise motion, or reversable clockwise motion combined with reversible counterclockwise motion, or (iv) one or more combinations of (i), (ii), or (iii);

a hub plate, a flywheel, a motor shaft of the motor, a hub mounting plate, and a floor mounting plate;

a drive shaft fixedly attached to the hub plate at a lower end of the drive shaft and fixedly attached to a torso portion of the training mannequin at an upper end of the drive shaft;

wherein the hub plate and the motor shaft are fixedly attached to the flywheel, the motor is fixedly attached to the hub mounting plate, and the hub mounting plate is fixedly attached to the floor mounting plate; and wherein the motor is for rotating the training mannequin upon activation of the motor.

2. A training mannequin comprising:

an upper body comprising:

a torso portion, a head portion, and a neck portion disposed between the torso portion and the head portion, a durable pliable outer shell covering the upper body, a skull-like structure disposed within the outer shell in an interior region of the training mannequin in the head portion, an elastic material disposed within the interior region between the skull-like structure and the outer shell and disposed throughout the interior region inside the outer shell in the neck portion and in the torso portion, and a deformable material disposed within a second interior region within the skull-like structure;

a sensor disposed within the deformable material for providing signals related to motion parameters of the training mannequin upon the training mannequin receiving a strike;

a hub plate, a flywheel, a motor having a motor shaft, a hub mounting plate, and a floor mounting plate;

a drive shaft fixedly attached to the hub plate at a lower end of the drive shaft and fixedly attached to the torso portion at an upper end of the drive shaft;

wherein the hub plate and the motor shaft are fixedly attached to the flywheel, the motor is fixedly attached to the hub mounting plate, and the hub mounting plate is fixedly attached to the floor mounting plate; and wherein the motor is for rotating the training mannequin upon activation of the motor.

3. The training mannequin of claim 2, wherein the sensor is for providing the signals related to motion parameters of the training mannequin in six degrees of freedom (DOF).

4. A training mannequin comprising:

an upper body comprising:

a torso portion, a head portion, and a neck portion disposed between the torso portion and the head portion, a durable pliable outer shell covering the upper body, a skull-like structure disposed within the outer shell in an interior region of the training mannequin in the head portion, an elastic material disposed within the interior region between the skull-like structure and the outer shell and disposed throughout the interior region inside the outer shell in the neck portion and in the torso portion, and a deformable material disposed within a second interior region within the skull-like structure;

a sensor disposed within the deformable material for providing signals related to motion parameters of the training mannequin upon the training mannequin receiving one or more strikes;

a motor coupled to the upper body, wherein the motor is for imparting rotational motion to the upper body upon activation of the motor under programmable control, the rotational motion chosen from being:

(i) at predictable speeds or at random speeds, or (ii) over predictable rotational angles or over random rotational angles, or (iii) predictable clockwise motion, random clockwise motion, predictable counterclockwise motion, random clockwise motion, or reversable clockwise motion combined with reversible counterclockwise motion, or (iv) one or more combinations of (i), (ii), or (iii);

a hub plate, a flywheel, a motor shaft of the motor, a hub mounting plate, and a floor mounting plate;

a drive shaft fixedly attached to the hub plate at a lower end of the drive shaft and fixedly attached to the torso portion at an upper end of the drive shaft;

wherein the hub plate and the motor shaft are fixedly attached to the flywheel, the motor is fixedly attached to the hub mounting plate, and the hub mounting plate is fixedly attached to the floor mounting plate; and wherein the motor is for rotating the training mannequin upon activation of the motor.

5. The training mannequin of claim 4, wherein the deformable material is formed of a material for holding the sensor in place within the deformable material.

6. The training mannequin of claim 4, wherein the sensor senses the one or more strikes received by the training mannequin.

7. The training mannequin of claim 4, wherein the sensor is for providing signals upon the one or more strikes received by the training mannequin for analysis.

8. The training mannequin of claim 4, wherein the sensor is for providing the signals upon the one or more strikes received by the training mannequin for correlating with a force sufficient to produce a concussion if the training mannequin were a real human being.

9. The training mannequin of claim 4, wherein the sensor is for providing the signals related to motion parameters of the training mannequin in six degrees of freedom (DOF).

10. The training mannequin of claim 4, wherein the rotational motion is for presenting certain positions of the training mannequin or for mimicking motion of a real opponent.

11. The training mannequin of claim 4, wherein the motor may instead not be activated for use with the training mannequin stationary.

12. The training mannequin of claim 4, wherein the signals are related to motion parameters of the training mannequin up to and including six (6) degrees of freedom (DOF), and wherein analysis of these motion parameters is for taking into account the rotational motion and whether the motion is towards or away from the direction of the strike or strikes to the training mannequin.

13. The training mannequin of claim 4, wherein the signals are for analyzing and measuring vectors having components in three (3) linear degrees of freedom DOFs and/or in three (3) rotational DOFs.

14. The training mannequin of claim 4, wherein the signals related to the motion parameters and the one or more strikes are for establishing one or more tolerance curves correlated to known or measured brain injuries for determining effects of actual strikes on a real human brain in training and/or in competition.

15. A method of making a training mannequin for detecting strikes thereto, comprising:

disposing a motion detecting sensor within a deformable material in a head portion of the training mannequin;

disposing the deformable material within an interior region of a skull-like structure in the head portion of the training mannequin; and disposing an elastic material in a region between an outer shell of the training mannequin and the skull-like structure, the elastic material providing shape and mass to the training mannequin and the outer shell forming the shape of an upper portion of a human body;

coupling a motor to the upper portion, wherein the motor is for imparting rotational motion to the upper portion upon activation of the motor under programmable control, the rotational motion chosen from being:

(i) at predictable speeds or at random speeds, or (ii) over predictable rotational angles or over random rotational angles, or (iii) predictable clockwise motion, random clockwise motion, predictable counterclockwise motion, random clockwise motion, or reversable clockwise motion combined with reversible counterclockwise motion, or (iv) one or more combinations of (i), (ii), or (iii);

fixedly attaching a drive shaft to a hub plate at a lower end of the drive shaft and fixedly attaching a torso portion of the training mannequin at an upper end of the drive shaft;

fixedly attaching the hub plate and a motor shaft of the motor to a flywheel;

fixedly attaching the motor to a hub mounting plate; and fixedly attaching the hub mounting plate to a floor mounting plate;

wherein the motor is for rotating the training mannequin upon activation of the motor.

16. The method of claim 15, wherein the disposing the motion detecting sensor comprises disposing the motion detecting sensor within the deformable material for providing signals for correlating to diffuse axonal injuries in humans.

17. The method of claim 15, wherein the disposing the motion detecting sensor comprises disposing the motion detecting sensor for sensing-a one or more strikes received by the training mannequin.

18. The method of claim 15, wherein the disposing the motion detecting sensor comprises disposing the motion detecting sensor for providing signals corresponding to one or more strikes received by the training mannequin for analysis and correlation with the effects similar one or more strikes would have to a real human brain.

19. The method of claim 15, wherein the disposing the motion detecting sensor comprises disposing the motion detecting sensor for providing signals corresponding to one or more strikes received by the training mannequin sufficient to cause a concussion if the training mannequin were a real human.

20. The method of claim 15, wherein the disposing the motion detecting sensor comprises disposing the motion detecting sensor in the deformable material in a region that represents a corpus callosum in a real human.

21. The method of claim 15, wherein the disposing the motion detecting sensor comprises disposing the motion detecting sensor for providing signals for predicting effects of one or more strikes to the training mannequin that would cause or be correlated to known, measured, or predicted diffuse axonal injuries in the real human corpus callosum.

22. The method of claim 15, wherein the disposing the motion detecting sensor comprises disposing the motion detecting sensor for providing signals for analysis to give feedback related to motion parameters from striking the training mannequin.

23. A method of making a training mannequin for detecting strikes thereto, comprising:

disposing a motion detecting sensor within a deformable material in a head portion of the training mannequin;

disposing the deformable material within an interior region of a skull-like structure in the head portion of the training mannequin;

disposing an elastic material in a region between an outer shell of the training mannequin and the skull-like structure, the elastic material providing shape and mass to the training mannequin and the outer shell forming the shape of an upper portion of a human body, wherein the disposing the motion detecting sensor further comprises disposing the motion detecting sensor for providing signals for analysis in establishing one or more tolerance curves correlated to known or measured diffuse axonal injuries in real humans;

fixedly attaching a drive shaft to a hub plate at a lower end of the drive shaft and fixedly attaching a torso portion of the training mannequin at an upper end of the drive shaft;

fixedly attaching the hub plate and a motor shaft of the motor to a flywheel;

fixedly attaching the motor to a hub mounting plate; and fixedly attaching the hub mounting plate to a floor mounting plate;

wherein the motor is for rotating the training mannequin upon activation of the motor.

24. The method of claim 23, wherein the disposing the motion detecting sensor further comprises disposing the motion detecting sensor for allowing a force or forces of strikes to the head portion to be recorded, measured, and analyzed from the signals while the training mannequin is rotating away from or into a strike for establishing the one or more tolerance curves.

25. The method of claim 23, wherein the disposing the motion detecting sensor further comprises disposing the motion detecting sensor for allowing a force or forces of strikes to the head portion to be recorded, measured, and analyzed from the signals while the training mannequin is stationary for establishing the one or more tolerance curves.

* * * * *